United States Patent [19]

Rabb et al.

[11] Patent Number: 4,961,092

[45] Date of Patent: Oct. 2, 1990

[54] PRE-PROGRAMMED PAUSES POST-COLLATION COPYING SYSTEM

[75] Inventors: Khalid M. Rabb, Webster; Robert L. Sklut; John W. Daughton, both of Rochester, all of N.Y.

[73] Assignee: Xerox Corporation, Stamford, Conn.

[21] Appl. No.: 446,961

[22] Filed: Dec. 6, 1989

[51] Int. Cl.[5] ..... G03G 21/00

[52] U.S. Cl. ..... 355/323; 355/318; 355/325

[58] Field of Search ..... 355/323, 325, 314, 318, 355/319, 321, 200, 201, 204, 308; 271/288, 289, 301

[56] References Cited

U.S. PATENT DOCUMENTS

| | | | |
|---|---|---|---|
| 3,944,207 | 3/1976 | Bains | 270/58 |
| 4,099,860 | 7/1978 | Connin | 355/314 |
| 4,162,848 | 7/1979 | Platt, III | 355/314 |
| 4,201,464 | 5/1980 | Botte et al. | 355/325 |
| 4,212,457 | 7/1980 | Guenther | 271/288 |
| 4,248,525 | 2/1981 | Sterrett | 355/323 |
| 4,275,958 | 6/1981 | Tachika et al. | 355/313 |
| 4,278,344 | 7/1981 | Sahay | 355/319 |
| 4,297,025 | 10/1981 | Bach et al. | 355/314 |
| 4,341,462 | 7/1982 | Ogura | 355/325 X |
| 4,358,197 | 11/1982 | Kukucka et al. | 355/322 |
| 4,361,320 | 11/1982 | Kikuchi et al. | 271/288 |
| 4,444,491 | 4/1984 | Rinehart et al. | 355/323 X |
| 4,522,486 | 6/1985 | Clark et al. | 355/323 |
| 4,568,172 | 2/1986 | Acquaviva | 355/323 |
| 4,602,776 | 7/1986 | York et al. | 271/4 |
| 4,782,363 | 11/1988 | Britt et al. | 355/321 |
| 4,830,590 | 5/1989 | Sumikawa et al. | 418/96 |
| 4,834,360 | 5/1989 | Acquaviva | 271/3.1 |
| 4,893,153 | 1/1990 | Sales et al. | 355/325 |

OTHER PUBLICATIONS

Xerox Disclosure Journal, vol. 13, No. 2, Mar./Apr. 1988, p. 99.

*Primary Examiner*—Arthur T. Grimley
*Assistant Examiner*—Sandra L. Hoffman

[57] ABSTRACT

A pre-programmable multiple pause points system for a post-collation copying system for a copier with associated plural sorter bins and a recirculating document handler (RDH) in which a set of document sheets may be loaded, recirculated, and copied for making a plural number of identical consecutive copies per document per circulation and outputting them to selected sorter bins for collation. This system is particularly adapted for a system of "limitless sorting" in which the plural identical copies are job subsets collated in a variable limited number of sorter bins normally substantially less than the total number of bins and wherein the total job is completed with further RDH document circulations and further job subsets productions. The preprogrammable pause points system provides for the automatic variable number of pauses or job interrupts and for their occurrence at those points in the copying cycle appropriate for inserting job inserts or other special copy sheets into the bins being filled, repeatably, at any selected document copying point.

9 Claims, 4 Drawing Sheets

10
100
18

16
11
12
17
19
14
15
13
20
25
22
24
26
1
2
3
4
5
6
N-1
N
21
23
32
40
44
46
47

*Operator runs desired interrupt job, and then actuates controller switchs to indicate completion of interrupt.

PRE-PROGRAMMED PAUSES POST-COLLATION COPYING SYSTEM

The present invention relates to an improved post-collation copying system in a copier with automatic document feeding and operatively connecting plural sorter or collator bins for post-collation of the copy sheets made therefrom, in which pauses to provide for special copy handling or processing such as inserts may be pre-programmed to automatically occur in varying plural numbers of pauses at the various points of copying preselected documents even where these selected documents are being re-copied more than once at different points or times in an overall copying job cycle, such as for limitless sorting, for more automatic and reliable production of complex or intermixed copy sets or jobs.

The disclosed copying system has particular utility for "limitless sorting" post-collation copying. In "limitless sorting" a plural number of copies can be made per document per document circulation and sorted by being separately fed into a subset of plural bins (and this plural number can vary in this disclosed system). One subset of sorter bins can be filled with copy sheets to form respective collated copy sets therein while the other subset of the total available number of sorter bins is being unloaded.

The disclosed system particularly relates to a special pre-programmable job interrupts or inserts system, for a system of post-collation "limitless sorting". As disclosed herein, the operator can pre-program the copier in advance of copying to automatically pause (temporarily stop copying, and/or go into a special interrupt mode of copying), within or at the end of each "limitless sorting" job subset, at one or more selected documents. i.e., pause at pre-specified original document page numbers after each time a pre-selected document has been plurally copied by its specified number of copies in the particular document copying circulation. Automatically pausing or stopping the regular job copying for a special job interrupt cycle at selected documents for each of the limitless sorting selected job subsets helps maintains job integrity and prevent missing the desired pause points, which can easily occur if this is done by attempting to manually stop the copier at desired pause points.

The disclosed automatic pre-programmable pause points copying system can provide for proper, identical, copying pauses for and/or within all sets being made by post-collation "limitless sorting", by automatically varying the number of pauses to correspond to the end point or last copy being made of a document in that circulation of that document within a production run producing a variable plural number of copy sets per circulation in plural document set circulations until the job is completed. This can be controlled by detecting the coincidence of each presentation for copying of a pre-programmed document and the last copy being made of that document at that time. The latter can be detected as a function of either the filling of the last available bin for those particular copies or the completion of copying of all the copy sets to be copied (the end of the entire job). The last available bin can be the last bin of a desired sub-set of copy sets sets selected to be filled in the limitless sort mode for that document set circulation, or the last available bin of the total bins available in the sorter unit being used.

The disclosed system automatically adapts to "limitless sorting" by automatically repeating each said pause for the number of times needed to accommodate "limitless sorting". That is, it provides a separate pause for each job segment or repeat for each pause-selected document. [In limitless sorting, the total job or total number of selected copy sets is typically made by breaking up the total job into plural job sub-segments alternatingly collated in different sorter bins sub-sections.]

The disclosed cycle-down pause points can be used to properly insert other sheets in the proper desired positions in the copy sets being made. These pause point insert sheets can be cover sheets, dividers, tabs, photos, highlight color copy sheets or any other desired special or pre-printed sheets, either manually inserted into the sorter bins, or made on the same copier. The latter can be special copies of other or special documents made on the same copier in a special job interrupt cycle automatically provided as disclosed herein. Such a job interrupt cycle can provide for either manual document placement on the copier imaging station during an interrupt, or automatic document feeding insertion during an interrupt from either a regular document feeder document stack input or from a special semi-automatic document input.

The present system is usable for the various modes of copying, i.e. with either simplex or duplex originals to produce either simplex or duplex copies, or mixtures thereof. It may also have extended utility for specially programmed pauses for inserts in uncollated or sets stacking output, if desired.

The present system is usable with conventional or other xerographic or other photocopiers and conventional or other automatic recirculating document handlers, and can reduce the number of recirculations and inversions of the document sheets by the recirculating document handler for many copying jobs in comparison to pre-collation copying.

The present system allows existing commercial duplex RDH's to have dual mode use, with different copying algorithms, to alternatively provide, with conventional plural sorter bins, a post-collation copying system therewith, and thus eliminate the cost and duplication of hardware and spare parts normally required for a separate, special, non-RDH document handler, as is typically used for post-collation copying. Thus one copier with one document handler can be sold in in both pre-collation and post-collation versions.

In the disclosed post-collation copying system a variable calculated number of plural identical copies made per circulation of the set of original document sheets can be collated, within approximately one (for simplex) or two (for duplex) circulations of the original document sheets, in a corresponding calculated variable plural number of selected sorter bins, normally substantially less than the total number of sorter bins, to provide variable limitless sorting, and this may be repeated, with recalculations of said variable calculated number, and selectable automatic pauses to allow additional copy sheets to be made and/or inserted, until the total quantity of said copy sets selected to be made has been completed.

With the general increases in speed and capabilities of modern copiers, there has been particularly provided improvements in automation, efficiency, speed and reliability in producing collated output, i.e., the output of copies of sets of original documents in collated copy sets, by various pre-collation or post-collation copying systems, as described in the references cited herein, and others.

The terms document, document sheet, or original, are used basically interchangeably in the descriptions herein, as referring to real, conventional, physical sheets of paper or the like sheet materials, usually flimsy, and usually but not necessarily image bearing. Documents may be either a true original or a previous copy being used as an original, sometimes called a "make ready". Unless specifically so indicated, they are not referring to electronic images, which are much more easily reordered and presented for copying than such real documents. Likewise, the respective "page" numbers illustrated on one side of a document and copy sheet here are not necessarily physical page numbers, they are explanatory visualizations of page order and/or controller count indicators. The term "document" here (and its first or second side or page number in the case of a duplex document) refers to the sheet or page being copied on the copier onto the corresponding "copy sheet", or "copy". The plural sheets of documents being copied in one commonly loaded set (which are usually, but not necessarily, collated), are referred to herein as a "document set" or "job". The "job" can also refers to the making of the requested number and type of copies made therefrom. A "simplex" document or copy sheet is one having an image or "page" on only one side or face of the sheet, whereas a "duplex" document or copy sheet has a "page", and normally an image, on both (its first and second) sides. The terms "first" and "second" sides are used herein for the opposite sides of a duplex document or copy sheet, and is consistent within a particular document set, but these terms are not intended or limited to "odd" vs "even" page sides, nor, unless specified, does this necessarily mean the order in which one particular set of sides is copied vs the other sides. It will be appreciated that for producing collated duplex copies (copy sets) of a duplex document set that the page or side order as well as the sheet order must be maintained, which adds difficulty and complexity to the job.

There is prior art including patent literature on various pre-programmed pauses or job interrupts in copying systems, for various reasons. Programmed pause points at selected document positions, i.e., at or before selected documents of a document job being copied, are known for copiers, especially for pre-collation copying systems with recirculating document handlers. e.g., the art on doing so with special control or "slip sheets" discussed in the Xerox Disclosure Journal (XDJ) publication Vol. 13 No. 2 of April 1988 at page 99 by T. Acquaviva, and in the Eastman Kodak copier systems discussed hereinbelow, etc.. Other controlled or selected pauses in copiers are show, for example in Sterrett U.S. Pat. No. 4,248,525, Tachika U.S. Pat. No. 4,275,958, etc..

"Priority interrupt", which is a form of pause in which a main copying job is temporarily interrupted to copy one or more other documents, and then the main job is restarted, is also known, e.g., U.S. Pat. Nos. 4,099,860, 4,162,848 and 4,297,025.

Pausing for the emptying of a portion of the sorter bins (part of a total job), for finishing, and then resuming the copying operation, in one form of a "post"-collation, or very limited total number of bins limitless sorting system, is disclosed for example in Xerox Corp. U.S. Pat. No. 4,358,197 issued Nov. 9, 1982 to W. P. Kukucka, et al. Limitless sorting and copy set collection post-collation using a 1 to N copying order RDH and a 12 bin sorter in which the alternate bins (every other bin, the odd numbered bins then the even numbered bins) are automatically unloaded in cycles is described.

Background prior art noted includes also Xerox Corp. U.S. Pat. No. 4,830,590 and 3,944,207 and other patents, discussed below, on the basic concept of "limitless sorting" with plural bin sets and a repeatable (recirculatable) automatic document feeder (ADF). Xerox Corp. U.S. Pat. No. 4,212,457, further discussed below, shows a dual mode copier with an RDH and sorter and switchover between pre and post collation operation. Said U.S. Pat. No. 4,212,547 also discusses in Col. 6 thereof providing for cover, insert or separation sheets (pre-printed or colored or transparent and/or heavier sheets) to be manually or automatically placed in the bins on one or both sides, and/or internally of, each copy set. Also noted is Xerox Corp. U.S. Pat. No. 4,602,776 as one example of automatic special sheet inserter apparatus for a copier with a sorter.

There is prior art on the basic concepts of a copier having both an RDH and a sorter, in combination, and with so-called "limitless sorting". As noted, Xerox Corporation U.S. Pat. No. 4,212,457, issued July 15, 1980 to J. Guenther, and also U.S. Pat. No. 4,757,356 issued July 12, 1988, disclose RDH/sorter combinations. Said U.S. Pat. No. 4,212,457 to J. Guenther teaches switching between pre-collation and post-collation copying on the same apparatus, and in the paragraph bridging Cols. 1 and 2 specifically refers to post-collation limitless sorting with reference to cited Xerox Corporation U.S. Pat. No. 3,944,207 issued Mar. 16, 1976 to S. S. Bains on "limitless sorting". Limitless sorting is a known copying mode alternately using two sets of sorter bins, one of which sets of bins can be filled while the other set of bins is being unloaded, as explained in said U.S. Pat. Nos. 4,212,457 and 3,944,207. Limitless sorting using two separate sets or sections of bins, and copying the documents by a number of times equal to the smaller of the number of bins in a section or the number of collated copy sets required, is taught in Xerox Corporation U.S. Pat. No. 4,830,590 issued Aug. 20, 1974 to H. Harris, et al, originally filed in 1971. Said U.S. Pat. No. 4,212,547 to J. Guenther also teaches forward or reverse (1—N or N—1) copying order (Col. 4 lines 43–45 (the latter also mentioning duplex copying)), and cites an RDH which is an N—1 feeding order type (4,078,787 cited at Col. 2 line 25), although the illustrated RDH 10 of said U.S. Pat. No. 4,212,457 is apparently a 1—N order document feeding type. Said U.S. Pat. No. 4,757,356 is particularly noted as to the duplex document RDH cited in Col. 6 lines 14–20 and lines 30–33.

Also disclosing copier/RDH/sorter combinations with switching between pre-collation and post-collation copying on the same apparatus, as said U.S. Pat. No. 4,212,457 to J. Guenther, are Canon Japanese laid open applications 59-111171,27.6.1984 and 60-37-567,26.2.1985.

Also of particular interest as relating to the subject of "limitless sorting" is U.S. Pat. No. 4,361,320 issued Nov. 30, 1982 to H Kikuchi, et al.. It discloses a single vertical array of bins divided (functionally) into two groups when the number of copies to be collated exceeds the number of bins, thus allowing copying to operate continuously and allowing an operator to remove the collated copies from one group while copies are being collated in the other group. When the number of pages of a document exceeds a predetermined number, the first group is defined to contain more bins than the second group, thereby reducing the number of times each document page must be fed to the copier. A. J. Botte, et al., U.S. Pat. No. 4,285,591 issued Aug. 25, 1981 to IBM, is also programmed to automatically segment the collator job when the number of document sets desired exceeds the capacity of the collator.

It is important to keep in mind the important known differences between pre-collation and post-collation copying in automatically making plural collated sets of copies of a set of documents. Pre-collation copying does not require a sorter or collator for collating the copy output. The copy sets come out already collated and these completed sets may be put directly into an output set stacker and/or finisher. However, pre-collation with physical documents requires a recirculating document handler (RDH) to plurally recirculate the document set, since normally only one (or two) copy sets are produced per circulation of the document set. In contrast, in post-collation copying, plural copies can be made in direct sequence from each document (or 2-up document pair) in a single presentation to the copying or imaging station, but then sorting (collation) of the output copies is required. Duplexing requirements likewise differ between the two copying systems. Post-collation copying has particular problems with duplex copying.

For example, if post-collation duplex to duplex copying were done in the same manner as normal pre-collation copying with an RDH, for making even two sets of duplex copy sheets four copying circulations of the duplex document set would be required. e.g., for an 8 page document set, in a first document circulation making only one copy of pages 7, 5, 3, 1; then in the second circulation making one copy of pages 8, 6, 4, 2; then in a third circulation one copy of pages 7, 5, 3, 1; then in a fourth circulation one copy of pages 8, 6, 4, 2.

This pre-collation sequencing is inefficient and undesirable for post-collation copying, where plural identical copies can be made to reduce document recirculations. However, calculating a more efficient variable number of plural identical copies which can be made under various copying conditions for various different post-collation copying jobs without violating various system limitations is difficult, and heretofore believed impractical, especially for a conventional RDH document handler not doing immediate inversion of duplex documents, i.e., an RDH which must return inverted documents to the document stacking tray before they can be copied again. Also, efficient post-collation duplex to duplex copying was believed to be very difficult for a conventional copier with a limited capacity duplex tray, which limits the number of plural copies of sides 1's which can be stored therein. The number of copies per document side 1 per circulation times the number of documents in the document set being copied should not exceed the duplex tray sheet capacity.

Some examples of Xerox Corporation RDH Patents, including those with inversion paths or inverters for inverting duplex documents, are U.S. Pat. No. 4,278,344 issued July 14, 1981 to R. B. Sahay; U.S. Pat. No. 4,459,013 issued July 10, 1984 to T. J. Hamlin et al; U.S. Pat. Nos. 4,428,667; 4,621,801, 4,579,444, 4,579,325 and 4,579,326 (similar to the RDH shown herein); and U.S. Pat. No. 4,794,429. Some other examples of recirculating document handlers are disclosed in U.S. Pat. Nos.: 4,076,408; 4,176,945; 4,428,667; 4,330,197; 4,544,148; 4,462,527; and 4,466,733, and other art cited therein.

It is important to note that in a conventional or "racetrack" RDH, such as are primarily cited above, that the documents are restacked after copying on top of the stack of documents in the RDH document tray, and are fed out for copying from the bottom of the stack. This limits the document copying order to the N to 1 (N−1) order in which the set of documents are loaded into to the RDH tray (N to 1 from bottom to top, with page 1 face up and on top, and therefore fed last by the bottom feeder). This also limits and controls the duplex copying sequencing in comparison to a so-called "immediate duplex" document handler in which a duplex document sheet can be inverted and immediately returned back to the platen to copy the second side immediately after the first side, rather than waiting for another circulation of the entire document set to get that same document back to the platen again. An example of the latter on a copier with a sorter is shown in Fuji Xerox Japanese Appln. No. 57-131265 filed 29.7.1982 and laid open 6.2.1984 as No. 59-23352 by Y. Nanba.

U.S. Pat. No. 4,278,344 to R. B. Sahay, although for a pre-collation system, is of interest as disclosing plural partial or buffer copy sets (first side copies) in the duplex buffer tray, the number of said plural buffer sets being a function of the total or maximum effective sheet capacity of that tray and a divisor of the number of duplex document sheets in the document set being recirculatively copied.

In normal prior duplex document duplex copying systems, all the documents in the document set being copied are inverted by the RDH during one circulation of the document set. It is assumed by the copier controller that all the documents in the document set are duplex documents requiring inversion to copy both their first and second sides. Also, in said prior duplex document duplex copying systems normally all the documents in the document set are being copied on one side thereof in each circulation (at least, after the first circulation, which in some systems is a non-copying inverting and/or pre-counting circulation).

Examples of pre, post or post-collated output system features are also disclosed, for example, in the above-cited U.S. Pat. No. 4,782,363 issued Nov. 1, 1988 and filed Sept. 17, 1987 by James E Britt, et al, and U.S. Pat. No. 4,834,360 issued May 30, 1989 by T. Acquaviva, and prior art references cited therein, and elsewhere herein, and in the Xerox Corporation "5090" "9900" and "1090" copiers.

As to control systems, some examples of various other prior art copiers with document handlers with control systems therefor, including document sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. In an RDH a document set separator conventionally counts document set recirculations by signaling each time the last sheet of the set is fed, e.g., U.S. Pat. No. 4,589,645. It is well known in general and preferable to program and execute document handler and copier control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either the provided verbal functional descriptions, such as those provided herein, or prior knowledge of those functions which are conventional, together with general knowledge in the software and computer arts. Controls may alternatively be provided utilizing various other known or suitable hardwired logic or switching systems.

The present invention overcomes various of the above-discussed and other problems, and provides various of the above-noted and other features and advantages.

A specific feature of the specific embodiment disclosed herein is to provide a method of copying a set of original document sheets with an automatic recirculating document handler on a copier with operatively connecting plurality of sorter bins for post-collation of the copy sheets made therefrom into copy sets, to make a desired total number of copy sets, the improvement comprising: pre-programming selected pause points associated with selected said document sheets for automatically pausing said copying for inserts for said copy sets; circulating the document sheets to and from the copying station of the copier for producing a subset plural number of copies per said document sheet per said document circulation and sorting those subset copies by feeding them into a subset of plural said sorter bins less than the total number of said connecting plurality of sorter bins, and repeating said production of copy subsets a variable number of times until the desired total number of copy sets has been made; automatically pausing said copying for said pre-programmed selected pause points associated with said selected document sheets at actual pause points which are also appropriate for inserts for said subset plural number of copies being made at that pause point, repeatedly automatically so pausing at said pre-programmed selected pause points for said repeated production of copy subsets.

Further specific features provided by the system disclosed herein, individually or in combination, include those wherein said automatic actual pause points provide for special copy handling inserts for more automatic and reliable production of complex or intermixed copy sets at all of the plural points of copying said preselected documents even though said selected documents are being re-copied by different numbers of subset copies at different points in making said desired total number of copy sets; and/or wherein said copying system is limitless sorting post-collation copying in which one subset of said sorter bins can be sequentially fed a subset of copy sheets to form respective plural collated copy sets therein while another subset of said sorter bins with a previous copying subset of plural collated copy sets is being unloaded, and/or in which said automatically pausing stops the regular copying job for a special job interrupt cycle at selected documents for each of the limitless sorting copying subsets; and/or wherein the pre-programming pre-programs pauses at prespecified original document page numbers which are to actually occur after each time a pre-selected document has been plurally copied by the total number of copies being made in a particular document copying circulation; and/or in which a calculated variable number of plural identical copies made of each document in a circulation of said document sheets is collated in one said subset in a corresponding calculated plural number of said selected sorter bins normally substantially less than the total number of said bins, and this is repeated with recalculations of said variable calculated number until the total quantity of said copy sets selected to be made has been completed; and/or in which said calculated variable number of plural identical copies made of each document in a circulation of said document sheets and said calculated plural number of said sorter bins is a repeatedly recalculated function of the total quantity of copy sets selected to be made, the remaining quantity of copy sets to be made, and the number of available sorter bins.

Further disclosed is a copier with connected plural sorter bins, utilizing a document handler in which a set of original documents are loaded, circulated, and plurally copied during a circulation, for making plural sets of copy sheets therefrom by making a plural number of identical consecutive copies per document per one circulation of said document set and outputting these copies to selected plural sorter bins, in which said plural identical copies are collated as copy sets in a corresponding plural number of said selected sorter bins, and in which this process may be repeated for plural circulations of the set of original document sheets, the improvement comprising: pre-programming selected pause points associated with selected said documents for automatically pausing said copying for inserts for said copy sets; and automatically pausing said copying for said pre-programmed selected pause points at actual pause points appropriate for inserts which are after said copying of said plural number of identical consecutive copies for that selected said document in that particular document circulation, and repeatedly automatically so pausing at said pre-programmed selected pause points for the repeated production of copy subsets; and/or in which the number of said copy subsets is normally less than the total number of said plural sorter bins and/or in which at said actual pause points said copier is automatically put into a job interrupt program for copying documents other than said set of original documents with said document handler.

All references cited in this specification, and their references, are incorporated by reference herein where appropriate for appropriate teachings of additional or alternative details, features, and/or technical background.

Various of the above-mentioned and further features and advantages of the invention will be apparent from the apparatus and its operation described in the specific example below. Thus, the present invention will be better understood from the following description of this exemplary embodiment thereof, including the drawing figures (approximately to scale) wherein:

FIG. 1 is a schematic frontal view showing in FIG. 1(*a*) an exemplary copier with duplexing, with an exemplary RDH providing duplex document inverting shown containing an exemplary set of duplex documents, and in FIG. 1(*b*) illustrating one example of serially connecting dual 20 bin sorters modules, for one example of a post-collation copying system in which the pre-programmable automatic pause system of the invention may be incorporated;

Figures 1A, 1B:
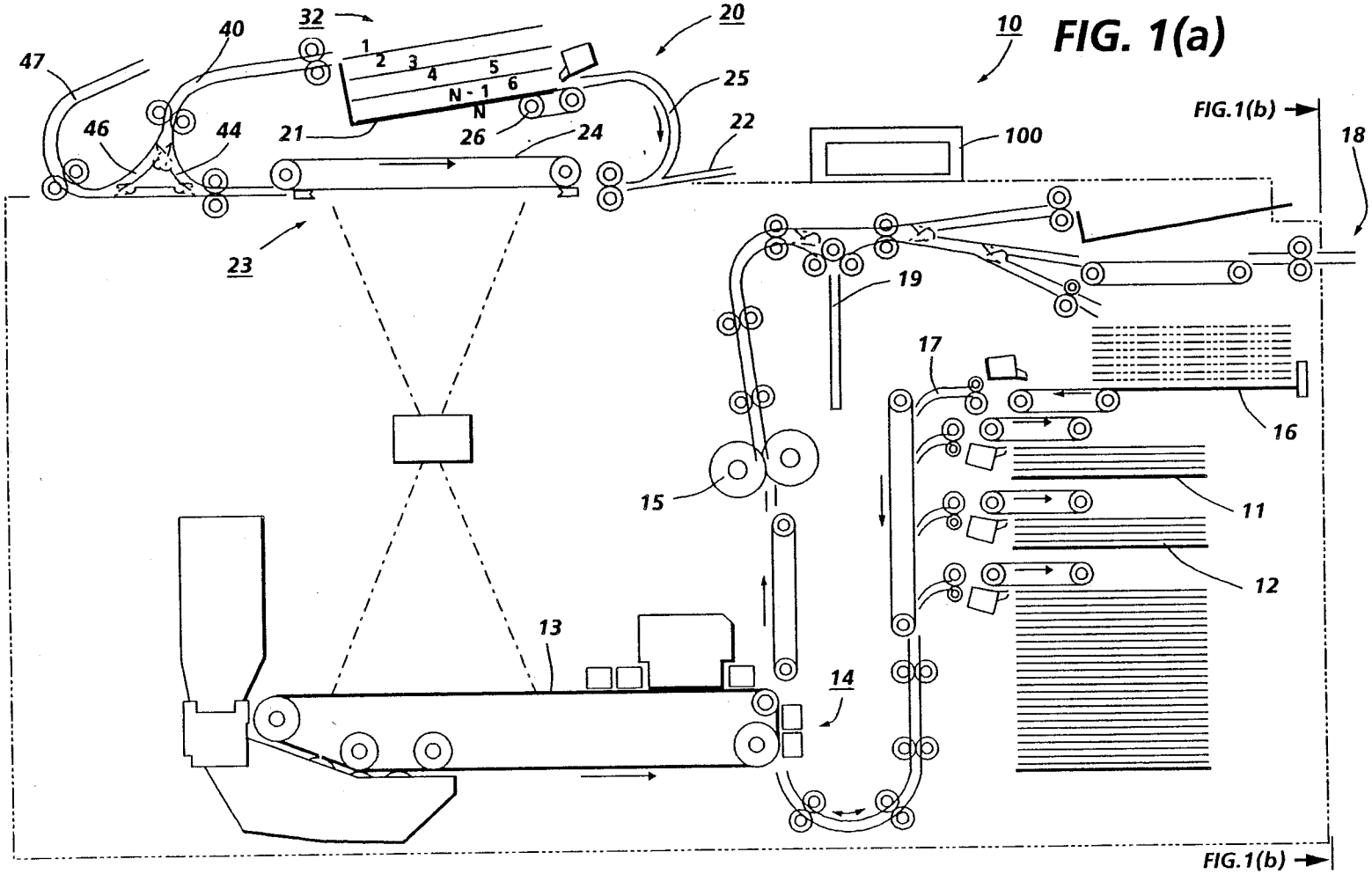
Figure 1:
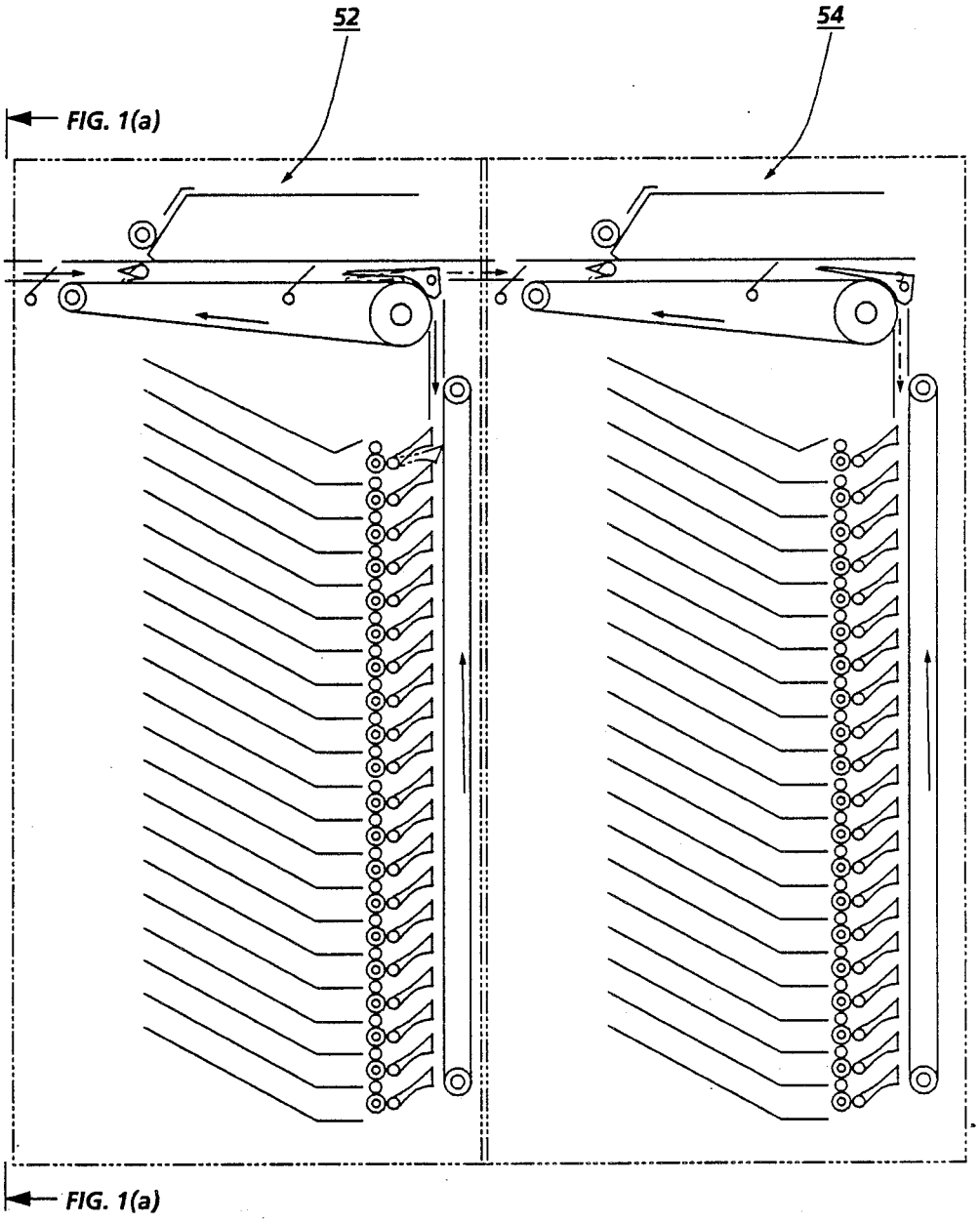

Describing now in further detail the specific example illustrated in the Figures, there is schematically shown in FIG. 1(*a*) an exemplary copier 10, with an exemplary recirculating document handler (RDH) 20. Both the copier 10 and RDH 20 are of a generally known type further described in art cited herein.

The exemplary copier 10 may be, for example, the well known Xerox Corporation "1075" or "1090" copiers, as illustrated and described in various patents cited above and otherwise, including U.S. Pat. No. 4,278,344, or various other xerographic or other copiers. Such a copier 10 is preferably adapted to provide in a known manner duplex or simplex collated copy sets from either duplex or simplex original documents circulated by the RDH 20. As is conventionally practiced, the entire document handler unit 20 may pivotally mount to the copier so as to be liftable by the operator up away from the platen for alternative manual document placement and copying.

The exemplary copier 10 and RDH 20 may alternatively be of various other similar or known types, such as are disclosed in above-cited patents. For example, the exemplary DH 20 structure illustrated here may be like that shown in U.S. Pat. No. 4,794,429 issued Dec. 27, 1988 to T. Acquaviva, or U.S. Pat. No. 4,731,637 issued Mar. 15, 1988 to T. Acquaviva and T. R. Cross. This general type of RDH is also shown in various cited and other patents thereon such as U.S. Pat. No. 4,579,444, etc..

For illustrative clarity here, the illustrated document and copy sheets are drawn here with exaggerated spacing between the sheets being stacked. In actual operation these stacked sheets would be directly superposed.

The RDH 20 provides for automatically feeding or transporting individual registered and spaced document sheets onto and over the imaging station 23, i.e., over the platen of the copier 10. For illustrative clarity here a platen is not fully illustrated in this schematic figure. The platen transport system 24 may be an incrementally servo motor driven non-slip or vacuum belt system controlled by the copier controller 100 in a manner taught by above-cited references to stop the document at a desired registration (copying) position.

The RDH 20 here has the conventional "racetrack" document loop path configuration, and preferably has generally known per se inverting and non-inverting return recirculation paths to the RDH loading and restacking tray 21. An exemplary set of duplex document sheets is shown stacked in this document tray 21. The RDH 20 is a conventional dual input RDH/SADH document handler, having an alternate semiautomatic document handling (SADH) side loading slot 22. Documents may be fed to the same imaging station 23 to be copied by the same platen transport belt 24 from either the SADH input 22 at one side of the RDH unit 20, or from the regular RDH input-the loading or stacking tray 21-on top of the RDH unit. As noted, that second document feeding input 22 is referred to herein as the SADH input 22, although it is not limited to semiautomatic or "stream feeding" document input feeding. This SADH input 22 is also known to be usable for special "job interrupt" insert jobs, as further discussed herein. The regular RDH document feeding input is from the bottom of the stack in tray 21 through an arcuate, inverting, RDH input path 25 to the upstream end of the platen transport 24. This input path 25 preferably includes a known stack bottom corrugating feeder-separator belt and air knife system 26, document position sensors, and a first set of turn baffles and feed rollers to naturally invert the documents once before copying.

Document inverting or non-inverting by the RDH may be as further described, for example, in the above-cited patents U.S. Pat. Nos. 4,794,429 or 4,731,637, etc.. Briefly, after the documents are copied on the platen imaging station 23, or fed across the platen without copying, they may be ejected by the platen transport system 24 into downstream or off-platen rollers and fed past a gate or gates and sensors. Depending on the positions of these gates, they either guide the documents straight out directly to a document output path to a catch tray, or, more commonly, the documents are instead deflected by a decision gate past a further sensor into an RDH return path 40 taking them back to tray 21 to restack on top of the documents then in tray 21, so that the document set can be continuously refed and recirculated. This RDH return path 40 includes reversible rollers to provide a choice of two different return paths to the RDH tray 21; a simplex return path 44 with one inversion, or a reversible duplex return path 46 without an inversion (called an inverter), as further explained below. For the duplex path 46 the reversible rollers are reversed to reverse feed the previous trail edge of the sheet back into the duplex return path 46 from an inverter chute 47 (curved in this case). This duplex return path 46 provides a desired inversion of duplex documents in one circulation, as they are returned to the tray 21, as compared to their previous orientation in tray 21, for copying their opposite sides in a subsequent circulation, or circulations, as described in the above-cited art. Normally this RDH inverter and inversion path 46,47 is used only for RDH input tray 21 loaded documents and only for duplex documents. In normal operation a duplex document has only one inversion per circulation (occurring in the RDH input path 24). In contrast, in the simplex circulation path there are two inversions per circulation, one in each of the paths 24 and 44. Two inversions per circulation equals no inversion. Thus, simplex documents are returned to tray 21 in their original (face up) orientation via the simplex path 44.

The entire stack of originals in the RDH tray 21 can be plurally recirculated and copied to produce plural collated copy sets. The document set or stack may be RDH recirculated any number of times to produce any desired number of collated duplex copy sets. That is, collated sets of duplex copy sheets.

Referring further to the exemplary copier or duplicator 10 here, since such copier operation and apparatus is known and taught in the cited and other art it need not be re-explained in detail herein. Briefly, blank or clean (or even pre-printed) copy sheets can be conventionally fed from paper trays 11 or 12 (or the high capacity feeder tray shown thereunder) to receive a copier document image on their first sides from photoreceptor 13 at transfer station 14, to be fused in a fuser 15, and outputted if they are to be simplex copies, or, if they are to be duplexed, temporarily stacked in a duplex buffer tray 16 for subsequent return (inverted) via path 17 therefrom for receiving a second side image in the same manner as the first side. This duplex tray 16 has a finite predetermined sheet capacity, depending on the particular copier design. The completed duplex copy is preferably exited to an integral finishing and stacking module via output path 18. An optionally operated copy path sheet inverter 19 is also provided.

Here the copier 10 output path 18 is directly connected in a conventional manner to two serially connected generally conventional 20 bin sorters 52 and 54, shown in FIG. 1(*b*). Xerox Corporation U.S. Pat. No. 3,467,371 issued Sept. 16, 1969, to J. E. Britt et al, shows a similar sorter arrangement. The two vertical bin arrays are conventionally gated to deflect a selected sheet into a selected bin as the sheet is conventionally transported past the bin entrance. An illustrated optional gated overflow top stacking or purge tray is also provided for each of the bin sets or modules 52 and 54. Conventionally, the first bin set 52 may be bypassed by actuation of a gate therein to direct sheets serially on to the second bin set 54, to increase the total number of bins available, and/or to alternatingly use the two bins sets for "limitless sorting", as described above.

All copier and document handler and sorter operations are preferably controlled by a generally conventional programmable controller 100. It is additionally programmed with certain novel functions described herein for the operation of the copier 10 and its RDH 20 here. The controller 100 preferably comprises a known programmable microprocessor system, as exemplified by the above cited and other extensive prior art, e.g., U.S. Pat. No. 4,475,156 and its references. The controller 100 controls all of the machine steps and functions described herein, including all sheet feeding. This includes the actuations of the document and copy sheet feeders and inverters, gates, etc.. As further taught in the references, the controller 100 also conventionally provides for storage and comparison of the counts of the copy and document sheets, the number of documents fed and recirculated in a document set, the desired number of copy sets, and other selections by the operator through a connecting panel of numerical and other control or function selection switches. Controller information and sheet path sensors are utilized to control and keep track of the positions of the respective document and the copy sheets and the operative components of the apparatus by their connection to the controller. The controller may be conventionally connected to receive and act upon jam, timing, positional, and other control signals from various sheet sensors in the document recirculation paths and the copy sheet paths. The controller automatically actuates and regulates the positions of sheet path selection gates depending upon which mode of operation is selected and the status of copying in that mode. The controller 100 also conventionally operates and changes displays on a connecting instructional display panel portion thereof, which preferably includes said operator selection buttons or switches. Here this machine controller 100 preferably includes a known touch-screen type of integrated operator input control and display.

A conventional document set separator in the RDH, connected to the controller 100, conventionally provides a signal indicating that the last sheet of the document set has been fed, i.e., a signal each time one complete document set circulation has been completed. See, e.g., U.S. Pat. No. 4,589,645.

Figure 3:
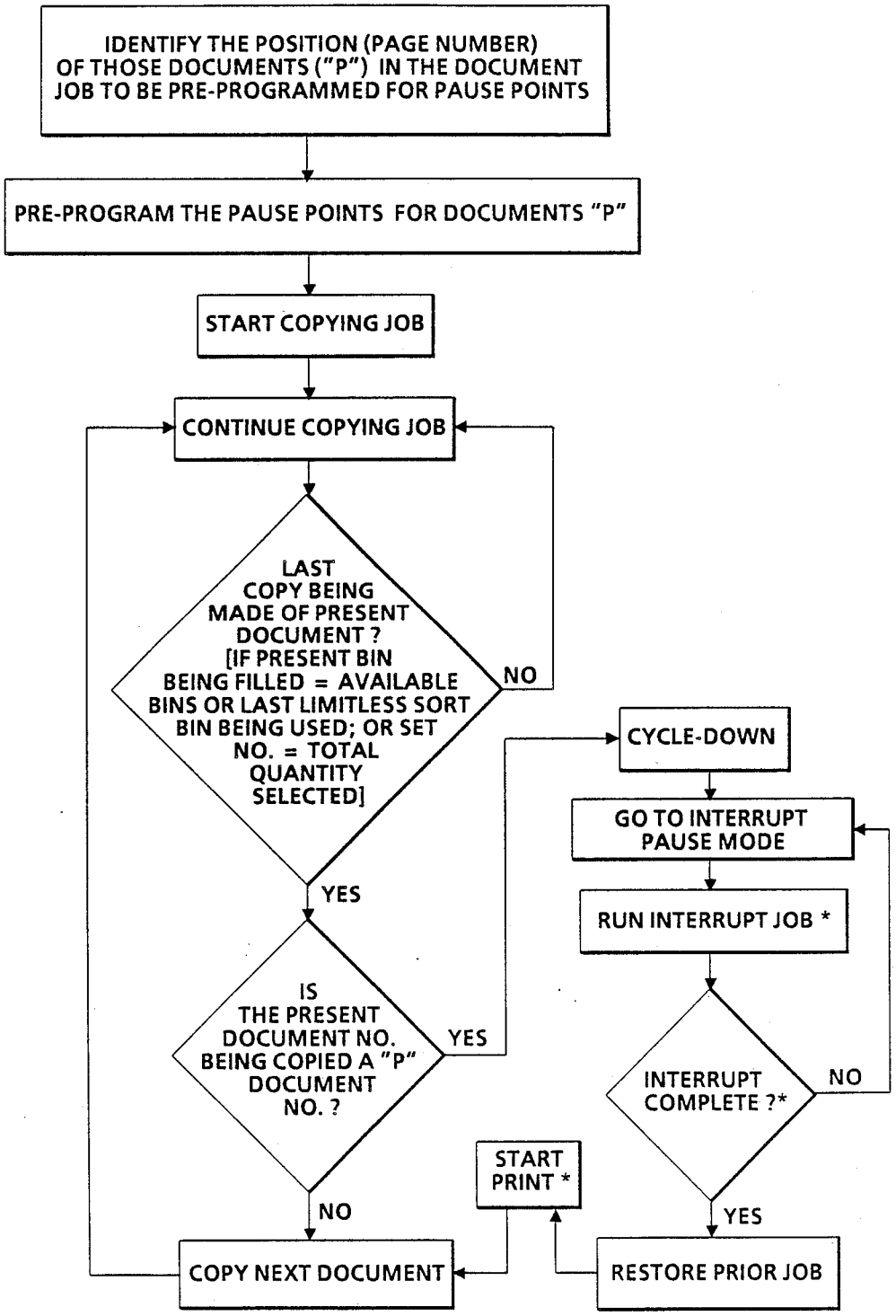
FIG. 3 is a schematic flow chart of one example of the disclosed pre-programmed pause points operating system.

Turning now to the specific example of the system disclosed herein, there is disclosed, and illustrated in FIG. 3, a special algorithm for "limitless sorting" in which the operator can pre-program the copier in advance to automatically pause or stop regular job copying for a special job interrupt cycle, at selected documents, e.g., at pre-specified original document page numbers, at the appropriate time each time that document is being copied (in each document circulation), even though a plural variable number of copies may be being made. This maintains job integrity, and prevents missing the desired pause point, which can occur if this is done by attempting manually stopping the copier at desired pause points.

The disclosed system particularly relates to a special pre-programmable job interrupts or inserts system for a special system of post-collation "limitless sorting". As noted, In "limitless sorting" a plural number of copies can be made per document per document circulation and sorted into a respective subset of plural bins. However, this number of copies per document per circulation can vary in this disclosed limitless sorting system, complicating the algorithm.

As disclosed herein, the operator can pre-program the copier in advance of copying to automatically pause (temporarily stop copying, and/or go into a special interrupt mode of copying), within or at the end of each of said variable number "limitless sorting" job subsets, and for any desired number of selected documents. i.e., to repeatedly automatically pause at all the pre-specified original document page numbers after each time each pre-selected document has been plurally copied by its specified or calculated number of copies for that particular document copying circulation. This automatic pausing or stopping the regular job copying for a special job interrupt cycle at selected documents for each of the limitless sorting job subsets helps maintains job integrity and prevent missing the desired pause points, which can easily occur if this is done by attempting to manually stop the copier at desired pause points.

The disclosed automatic pre-programmable pause points copying system provides for proper, identical, copying pauses for and/or within all sets being made by post-collation "limitless sorting", by automatically varying the number of pauses to correspond to the end point or last copy being made of a document in that circulation of that document within a production run which is producing a variable plural number of copy sets per circulation in plural document set circulations until the job is completed. This can be controlled by detecting the coincidence of each presentation for copying of a pre-programmed document and the last copy being made of that document at that time. The latter can be detected as a function of either the filling of the last available bin for those particular copies or the completion of copying of all the copy sets to be copied (the end of the entire job). The last available bin can be the last bin of a desired sub-set of copy sets sets selected to be filled in the limitless sort mode for that document set circulation, or the last available bin of the total bins available in the sorter unit being used.

That is, this algorithm automatically adapts to "limitless sorting" by automatically repeating each said pause for the number of times needed to accommodate "limitless sorting". It provides a separate repeat pause for each job segment and each pause-selected document. In limitless sorting, the total job (the total number of selected or requested copy sets) is made by breaking up the total job into plural job sub-segments alternatingly collated in different sorter bins sub-sections. i.e., in limitless sorting, the total job is broken up into plural job segments or subsets alternatingly put into different subsets of the sorter bins, each bin subset being only limited plural number bins less that the total number of bins available. Thus the operator can be unloading one subset of bins while another sub-set of bins is being filled. This also allows more copy sets to made made than the total number of bins available, by pausing until one subset of bins is emptied and free to be filled again.

Normally, as in any normal post-collation system, one copy sheet made from one document is placed in one selected bin at a time from the copier for all of the selected bins of the selected subset of bins, and this is repeated for each document of the document set, until a complete collated set is completed in each of these bins. bin. This may be done in one circulation of the document set. Then this may be repeated to fill the next subset of bins in the next copying circulation of the document set by the document handler.

Referring to the FIG. 3 flowchart, there is illustrated the following sequences or steps. The operator identifies the position (page number) of all those documents (called "P" here) in the document job desired to be pre-programmed for pause points. The operator pre-programs these pause points for documents "P" as instructed on the integrated display and control panel. The operator then starts the copying job, which continues automatically until an end of subset condition is reached and detected in the controller. This condition is reached when the last present plural copy is being made of the present document being copied. Here, this is detected when either: (1) the present bin being filled is equal to the number of available bins or the last bin being used in that particular limitless sort copying sub-cycle is reached; or (2) the present set number is equal to the total quantity of copy sets selected. Then, there is a check to see if the present document being copied a "P" document. If not, the next document is copied normally. If it is a "P" document, there is an automatic cycle-down, and the copier automatically goes into a special pause or interrupt mode. When the interrupt job is completed the prior job is restored simply by operator switch actuation to continue document circulation and normal copying of the next regular documents. In the interrupt mode an interrupt job can be run to make insert copies and put them into the bins being filled at that pause point, or manual inserts can be made into these bins. i.e., the operator can run any desired interrupt job, and then the operator can actuate a displayed controller touch screen area or other switch to indicate completion of the interrupt, and/or actuate the regular "start print" switch (both are shown here, although actuation of one could be eliminated), and thereby restart the regular job to continue automatically (until the next programmed pause point, if any). But note that the actuation of the start of the pause time for the interrupt job was automatically provided without any required operator input at that time.

To express this another way, it may be seen that as each pause-programmed document number was reached, the pause algorithm had also checked to see if one of the following two additional conditions had been met [and this query repeats in the same manner for all document circulations until the total number of copy sets programmed (operator requested) has been made of that document set]: (1) all available bins (of the set of the plural bin sets available, or being used or at that point for the particular limitless sorting subset) had been filled at that point; or (2) the total number of copies selected had been completed in that job segment set, i.e., the present bin being used was the last bin needed to be used to complete the total job (copy set number being made=quantity selected). If either condition was met, the copier paused and went into its special interrupt cycle, and stayed there until the operator completed and terminated the special pause program cycle and actuated the "start print" button again.

If the operator has selected a desired copy quantity of more than the total number of bins in the bin module or modules being used, so that the copying cycle must repeat to complete the job, the copier will also, but conventionally, cycle-down in the times the bins must be cleared and refilled if the conventional bin sensors indicate the bins are not cleared and therefore are not available. That may or may not coincide with a cycle-down in this system.

As noted, these disclosed cycle-down pause points can be used to properly insert other sheets in the proper desired positions in the copy sets being made. These pause point insert sheets can be cover sheets, dividers, tabs, photos, highlight color copy sheets or any other desired special or pre-printed sheets, either manually inserted into the sorter bins, or made on the same copier. The latter can be special copies of other or special documents made on the same copier in a special job interrupt cycle automatically provided as disclosed herein. Such a job interrupt cycle can provide for either manual document placement on the copier imaging station during an interrupt, or automatic document feeding insertion during an interrupt from either a regular document feeder document stack input or to a special semi-automatic document input. That is, the disclosed cycle-down pause points can be used to: hand insert covers, photos or other such special sheets into the sorter bins, or to make and insert into the copy sets special highlight color copies made in a dual pass or other special copy cycle, or to insert a special document into an SADH input of the RDH to copy at that point [a traditional job interrupt, but with a number of copies being made equal to the number of bins being utilized at that point in the copying cycle] to merge into the other copy sheets in the bins, or to use the copier platen (document glass) for making copies of manually inserted documents at that point, or to use the regular RDH top tray input (the top document Feeder (TDF) input of the RDH) and use the job interrupt cycle to remove the existing document set there and make special insert copies from a stack of other documents then loaded there at the pause points to interleave them onto the sets in the sorter bins. [In the latter case the operator can be prompted via appropriate messages to re-insert the primary job originals into the TDF at the appropriate time to maintain complete job integrity.]

In the disclosed post-collation copying system a variable calculated number of plural identical copies made per circulation of the set of original document sheets can be collated, within approximately one (for simplex) or two (for duplex) circulations of the original document sheets, in a corresponding calculated variable plural number of selected sorter bins, normally substantially less than the total number of sorter bins, to provide variable limitless sorting, and this may be repeated, with recalculations of said variable calculated number, and selectable automatic pauses to allow additional copy sheets to be made and/or inserted, until the total quantity of said copy sets selected to be made has been completed.

Further illustrated here as one example of such a limitless sort post-collation copying system, is a novel duplex one which is the subject of a commonly assigned and filed application, by the same K. Rabb, et al, wherein in one pass or circulation of the documents, plural identical copies of each document are desirably made in direct sequence and put into a duplex buffer tray, and then in the next document set circulation all these copies are fed out of the duplex tray so that the other sides of the duplex documents can be copied onto all of the other sides of the copy sheets fed from the duplex tray, and these plural identical uncollated duplexed copy sheets then being separately placed in separate bins of a sorter or collator for post-collation. However, in practice, this must be done differently, and repeated, to produce a desired number of copies under different copying circumstances, as will be described herein. Thus heretofore, it was not conventional or practical to make duplex copies to be collated in a sorter from duplex originals recirculated in an RDH. The difficulties in doing so will be more fully seen apparent from the complexity of the operational algorithm and examples described herein.

Figure 2:
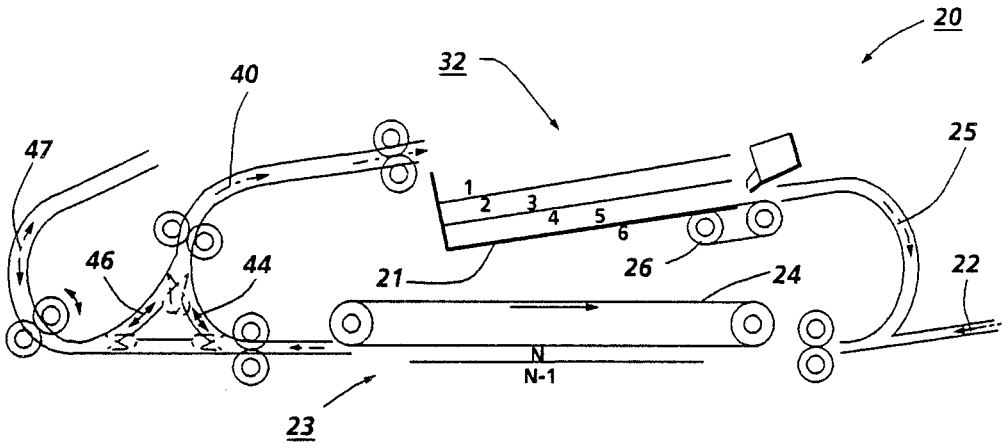
FIG. 2 is an enlarged view of the RDH of FIG. 1.

The illustrated operation of the copier 10 here is for one example of the subject duplex to duplex post-collation copying mode. There is shown by way of one example a xerographic copier type of reproducing machine 10 feeding and copying a sample document set 32 comprising conventional duplex document originals numbered here ½, ¾, 5/6, [etc.], to the N−1/Nth document sheet. They are shown as initially loaded into the RDH 20 tray 21 in FIG. 1(*a*), and in FIG. 2 are shown in copying the first (N−1/Nth) document to be copied.

As described and shown, this document set 32 is conventionally loaded into the RDH 20 tray 21, and the bottom sheet is then fed out to the imaging station 23 and copied there on its exposed first side, and the copy thereof is put into the duplex tray 16. For illustrative purposes, an exemplary set of intermediately simplex (duplex buffer set) copy sheets is shown in the duplex tray 16 in phantom. The second sides of the documents are then copied onto these sheets from the duplex tray 16 in a subsequent circulation of the document set, i.e., after the documents have been inverted so that their second sides can be copied.

As noted, a conventional recirculating document handler, as here, has its duplex document inversion occurring on the way back to the top document feeder. This mechanical hardware restriction and the duplex tray capacity restriction needs a unique algorithm for running 2 sided to 2 sided post-collation jobs with the document handler (duplex-to-duplex mode). However, the use of the RDH enables a type of "limitless sorting".

The desired features of this algorithm are to: (1) minimize recirculations of the documents; and (2) maximize productivity, i.e., minimize copier dead cycles or skipped pitches. This algorithm will be described, and an example provided.

An algorithm satisfying these requirements in a copier with duplex buffer tray duplexing and a normal RDH duplex document copying order has additional requirements for post-collation duplex copying as follows: Copies of side 1's (the first document side copied) are sent to the copier's duplex tray to wait for side 2 copying, as described above. Since side 2 of the document will not be available until the rest of the document stack has been recirculated in the document handler, as described above, the duplex tray must hold all side 1 copies of all document sheets, N though 1. The number of copies of each original that can be made per pass (in one circulation of the documents) is a function (F) of the duplex tray capacity, the number of originals in the document set being copied, the number of copies selected to be made, and the limits of the sorter (the maximum usable number of sorter bins available of the particular copier/sorter).

Therefore: The number of copies made per original in the current document set circulation (the number of consecutive document flashs or scans)=F (duplex tray capacity; number of originals; number of sorter bins; and remaining quantity of copy sets to be copied). Where F=smallest of: [see definitions below]

(1) duplex tray capacity÷number of originals
(2) quantity selected
(3) number of sorter bins
(4) Remaining quantity of copy sets Assume here for this example that the "duplex tray capacity"=100 (for this exemplary copier). This particular number is a function of the particular copier used.

The "number of originals" is a number determined by a conventional pre-count (an initial counting circulation of the document set in the RDH), or by a numerical key entry by the copier operator. {Unless the "quantity selected" is only one copy set.}

The "quantity selected" is the total quantity of copy sets selected to be made. This information was stored in the controller from the initial numerical key entry by the copier operator for the number of desired copies.

The "number of sorter bins" is the maximum number of sorter bins available to put copy sheets into at that point in time. Here, in this example, for this particular sorter, this number is either 20 or 40, depending on whether there are provided one or two 20 bin sets or modules of sorters (This number is a preset selection in non-volatile memory by the service representative at the initial installation of the copier/sorter unit), OR the number of remaining (unfilled) bins in the sorter module, whichever is less.

The "remaining quantity of copy sets" is the remaining quantity of copy sets to be made at this point (in the present document set circulation). It is determined by the formula: remaining quantity of copy sets=(quantity selected - quantity already made).

For one example of a scheduling sequence, assume examples of numbers for the above algorithm as follows:

duplex tray capacity=100
number of originals=30
quantity selected=10
number of sorter bins=20.

Therefore, for this example, applying the formula, F=smallest of: (1) duplex tray capacity÷number of originals, (2) quantity selected, (3) number of sorter bins, or (4) remaining quantity of copy sets=duplex tray capacity÷number of originals (=100÷30 here), and therefore the number of copies made per original (flashes per original) in this example=100÷30=3. (Except for the last or closeout circulations, for the final "remaining quantity of copy sets", as will be shown.)

The actual copying sequences for this particular example will now be illustrated below. These examples are used or written with scheduler acronyms in the form of "C x,y,z". The following is the key to these scheduler acronyms:

C=Commit (commit copy sheet to paper path)
x=sheet number
y=side number
z=set number (Thus, for example, C2,2,4 means commits sheet number 2, side 2, of copy set number 4 to the paper path.)

First document set circulation copies:
C1,1,1 C1,1,2 C1,1,3 C2,1,1 C2,1,2 C2,1,3 . . . C29,1,1 C29,1,2 C29,1,3 C30,1,1 C30,1,2 C30,1,3
(Note: All of these 90 copy sheets go into the duplex tray. These copy sheets are the three identical side 1 copies of each document of copy sets 1 through 3, in this example. Meanwhile the RDH has inverted each duplex document after its removal from the platen, in preparation for the second document circulation.)
Second document circulation copies:
C1,2,1 C1,2,2 C1,2,3 C2,2,1 C2,2,2 C2,2,3 . . . C29,2,1 C29,2,2 C29,2,3 C30,2,1 C30,2,2 C30,2,3
(These are the side 2 copies of copy sets 1 through 3. All these 90 sheets are fed from the duplex tray to be second side copied and then fed to the copier output and on sequentially to three respective sorter bins 1,2,3 for collation of these three sets being made at a time in this example. Meanwhile, the documents are inverted again (and in the subsequent circulations).)
Third document circulation copies:
C1,1,4 C1,1,5 C1,1,6 C2,1,4 C2,1,5 C2,1,6 . . . C29,1,4 C29,1,5 C29,1,6 C30,1,4 C30,1,5 C30,1,6
(All these sheets are going to the duplex tray. These are side 1 copies of copy sets 4 through 6.)
Fourth document circulation copies:
C1,2,4 C1,2,5 C1,2,6 C2,2,4 C2,2,5 C2,2,6 . . . C29,2,4 C29,2,5 C29,2,6 C,30,2,4 C30,2,5 C30,2,6
(All sheets fed from duplex tray to output after copying. These are side 2 copies of copy sets 4 through 6, respectively going into sorter bins 4,5,6.)
Fifth document circulation copies:
C1,1,7 C1,1,8 C1,1,9 C2,1,7 C2,1,8 C2,1,9 . . . C29,1,7 C29,1,8 C29,1,9 C30,1,7 C30,1,8 C30,1,9
(All sheets going to duplex tray. These are side 1 copies of copy sets 7 through 9.)
Sixth document circulation copies:
C1,2,7 C1,2,8 C1,2,9 C2,2,7 C2,2,8 C2,2,9 . . . C29,2,7 C29,2,8 C29,2,9 C30,2,7 C30,2,8 C30,2,9
(All sheets fed from duplex tray, copied, and on to output. These are side 2 copies of copy sets 7 through 9, going into bins 7,8,9. Note that the "remaining quantity of copy sets" at this point for this example is one set-set number 10.)
Seventh document circulation copies:
C1,1,10 C2,1,10 . . . C29,1,10 C30,1,10
(All these 30 copy sheets are going into the duplex tray. These are side 1 copies of copy set 10 only (the last copy set).)
Eighth document circulation copies:
C,1,2,10 C2,2,10 . . . C29,2,10 C30,2,10
(These are the side 2 copies of the last copy set 10. These are the same sheets as in the seventh document circulation, now being fed from the duplex tray to be second side copied and outputted to bin 10.)

To provide another example, again assume a 100 sheet duplex tray capacity, only this time 50 copy sets are required from a 16 page original document set. $100 \div 16 = 6$ copies to be made at a time of each of the sides 1's and put into the duplex tray, plus a rounded-down integer reminder of 4 to be made in the last two circulations.

Note that here, as also shown in the previous example, only a limited number of the total number of bins (6 bins here) are being used at a time, until these last 4 reminder copy sets are made. Since only 6 identical copies are being made at a time, only 6 bins at a time are need for collation, for this job, since the above calculated buffer size here was 6. Thus, here copy sets 1–6 can be loaded into bins 1–6. Then copy sets 7–12 can be loaded into bins 7–12. Then copy sets 13–18 can be loaded into bins 13–18. At this point, assuming only 20 total bins were available in this case (using only one 20 bin set or array), only 2 are left and the number of available bins is less than the calculated buffer size. Thus two copies per original can be made at this point (copy sets 19 and 20), instead of 6, and loaded into bins 19 and 20. Meanwhile, if bins 1–6 have now been unloaded (per displayed instructions to the operator to do so) then the copier can automatically continue on without pausing to make and load copy sets 21–27 into bins 1–6, etc., etc., until all the 50 copy sets requested here in this example have been completed. Or, if the illustrated second set of 20 bins is utilized, then those bins can be loaded next, before bins 1–6 of the first bin set are needed to be used again. It may be seen that this 50 copy set example with either one or two 20 bin sorters was run with the following buffer sizes (numbers of identical copies per document per circulation): 6,6,6,2;6,6,6,2;6,4=50 copy sets.

It may be seen that an automatically variable bin set number type of "limitless" sorting system is automatically provided here in which the number of bins being used at one time is, in most cases, less than the number of bins available. The job is effectively divided into job sub-sets using different sizes of bin sub-sets. To express this generically, this is a type of "limitless" sorting in which the number of bins (the bin sub-set) used for each job is determined from the duplex tray capacity and the number of documents being copied, rather than the number of bins in a bin array or fixed subset of bins as in normal "limitless" sorting. [Unless this calculated number of bins needed for the job is greater than the available number of bins in the bin set.]

Turning now to an example of generalized software instructions for implementing this general algorithm in a controller or other computer, one is as follows:

```
Procedures/Processes: Determine duplex Buffer
Description: Called up when job is started and before next buffer set
(job subset) is run (i.e., run for each job subset)
{Note: ** = notes, not instructions.}
ENTER:
Buffer sets required = CALCULATE[100* ÷ the number of originals];
*(100 is the duplex tray capacity in this example)
**[NOTE: The result of this division returns the truncated whole number
(integer) part of the calculation.]
IF
buffer sets required > quantity selected [the number of copies programmed in
by the operator];
THEN
buffer sets required = quantity selected;
IF
buffer sets required > available bins;
THEN
buffer sets required = available bins;
IF
(set number [the number of the particular copy set then being made] + buffer
sets required) > quantity selected;
**[This is a dynamic safety check for the end of job.]
THEN--**[Don't need that many buffer sets.]
buffer sets required = (quantity selected − set number);
END THIS PROCEDURE: Determine buffer.
Further procedures/processes for ADH duplex to duplex:
IF
present bin being loaded ≠ 20*;
*[This number is preset to the maximum number of bins available. 20 is the
number of bins for the sorter module in this particular example.]
THEN--**[Not doing a forced switch to next bin array, so recalculate buffer set
requirement.]
IF
(present bin being loaded + buffer sets required) > available bins;
THEN
buffer sets required = available bins − present bins;
IF
(set number + buffer sets required) > quantity selected
THEN--**[Check to see if near the end of the job.]
buffer sets required = quantity selected − set number;
END
```

It may be seen that even the above-disclosed system of variable numbers of subsets and bins for duplex to duplex copy post-collation copy production is usable with, and directly incorporatable with, the previously described system of pre-programmed pause points and displayed operator instructions. These pre-programmed pause points may be compatibly provided to provide additional time for special inserts, or even for for bin unloading in some cases. Furthermore, with additional operator input and software, the copier could be programed so that even another job can be started or run using the other available bins while the prior job is being unloaded from these utilized bins.

It should be again noted that the subject system here is not limited to a duplex to duplex system or mode. And even in that mode, it can also include or incorporate some special cases of specially programmed intermixed simplex originals or simplex copies. For example, chapterization, or tab inserts. The copying system herein can be automatically tied by the controller 100 to suitable tabbing or covers inserts and/or "chapterization" of subsets of copy sheets. For example, the commonly assigned and substantially concurrently filed application by the same K. M. Rabb, et al, U.S. Ser. No. 07/445,819, on handling simplex tab originals and simplex tab copies intermixed with normal duplex originals and duplex copies. "Chapterization" is automatically providing the beginning of a subset or chapter within a copy set on the facing page immediately following the last page of a chapter end or a tab insert sheet, so that the beginnings of chapters are conventionally started on a right hand side page following an appropriately positioned blank (simplexed) left side copy sheet page, even if intermixed with otherwise duplexed copies. An example of "chapterization" (for a pre-collation system), is described in U.S. Pat. No. 4,640,607 issued Feb. 3, 1987 to Richard L. Bray (Eastman Kodak Company).

The present system allows existing commercial RDH's to alternatively be used "as is", for cost savings, with a new copying algorithm, to alternatively provide, with conventional plural sorter bins, a flexible post-collation copying system usable with many intermixed or other special copying jobs. The RDH document handler can have plural mode use, including special job interrupt or document insert feeding. There is no additional cost or duplication of hardware and spare parts for a separate, special, non-RDH document handler for post-collation copying. One copier with one document handler can be sold in both pre-collation and post-collation versions. The present system can help minimize the number of document recirculations and inversions and maximize productivity and operator simplicity even for complex jobs in post-collation limitless sorting copying.

While the embodiment disclosed herein is preferred, it will be appreciated from this teaching that various alternatives, modifications, variations or improvements therein may be made by those skilled in the art, which are intended to be encompassed by the following claims:

We claim:

1. In a method of post-collation copying a set of original document sheets with an automatic recirculating document handler on a copier with an operatively connecting plurality of sorter bins for post-collation of the copy sheets made therefrom into copy sets, to make a desired total number of copy sets, the improvement comprising:

pre-programming selected pause points associated with selected said document sheets for automatically pausing said copying for inserts for said copy sets;

circulating the document sheets with said recirculating document handler to and from the copying station of the copier for producing a subset plural number of copies per document sheet per document circulation and sorting those subset copies by feeding them into a subset of plural said sorter bins less than the total number of said connecting plurality of sorter bins, and repeating said production of copy subsets a variable number of times until the desired total number of copy sets has been made;

automatically pausing said copying for said pre-programmed selected pause points associated with said selected document sheets at actual pause points which are also appropriate for inserts for said subset plural number of copies being made at that pause point, and repeatedly automatically so pausing at said pre-programmed selected pause points for said repeated production of copy subsets.

2. The post-collation copying method of claim 1, wherein said automatic actual pause points provide for special copy handling inserts for more automatic and reliable production of complex or intermixed copy sets at all of the plural points of copying said selected documents even though said selected documents are being re-copied by different plural numbers of subset copies at different points in making said desired total number of copy sets.

3. The post-collation copying method of claim 1, wherein the copying system is a limitless sorting post-collation copying system in which one subset of said sorter bins can be sequentially fed a subset of copy sheets to form respective plural collated copy sets therein while another subset of said sorter bins with a previous copying subset of plural collated copy sets is being unloaded, and in which said automatically pausing stops the regular copying job for a special job interrupt cycle at selected documents for each of the limitless sorting copying subsets.

4. The post-collation copying method of claim 1, wherein pre-programming of selected pause points pre-programs pauses for pre-specified original document page numbers, and said actual pause points occurs after that pre-specified document page has been plurally copied by the total number of copies being made in that particular document copying circulation.

5. The post-collation copying method of claim 1, in which a calculated variable number of plural identical copies made of each document in a circulation of said document sheets is collated in one said subset in a corresponding calculated plural number of said selected sorter bins normally substantially less than the total number of said bins, to provide limitless sorting, and this is repeated with recalculations of said variable calculated number until the total quantity of said copy sets selected to be made has been completed.

6. The post-collation copying method of claim 5, in which said calculated variable number of plural identical copies made of each document in a circulation of said document sheets and said calculated plural number of said sorter bins is a repeatedly recalculated function of the total quantity of copy sets selected to be made, the remaining quantity of copy sets to be made, and the number of available sorter bins.

7. In a post-collation copying system, for a copier with connected plural sorter bins, utilizing a document handler in which a set of original documents are loaded, circulated, and plurally copied during a circulation, for making plural sets of copy sheets therefrom by making a plural number of identical consecutive copies per document per one circulation of said document set and outputting these copies to selected plural sorter bins, in which said plural identical copies are collated as copy sets in a corresponding plural number of said selected sorter bins, and in which this process may be repeated for plural circulations of the set of original document sheets, the improvement comprising:

pre-programming selected pause points associated with selected said documents for automatically pausing said copying for inserts for said copy sets;

and automatically pausing said copying for said pre-programmed selected pause points at actual pause points appropriate for inserts which are after said copying of said plural number of identical consecutive copies for that selected said document in that particular document circulation, and repeatedly automatically so pausing at said pre-programmed selected pause points for the repeated copying of said documents in further document circulations.

8. The post-collation copying system of claim 7, in which the number of said copies per document per circulation is normally less than the total number of said plural sorter bins.

9. The post-collation copying system of claim 7, in which at said actual pause points said copier is automatically put into a job interrupt program for copying documents other than said set of original documents with said same document handler.

* * * * *